United States Patent [19]

Bernard et al.

[11] 4,031,489

[45] June 21, 1977

[54] VHF HIGH-POWER BROADBAND ISOLATORS

[75] Inventors: Nicolle Bernard; Gerard Forterre, both of Paris, France

[73] Assignee: Societe Lignes Telegraphiques et Telephoniques, Paris, France

[22] Filed: June 29, 1976

[21] Appl. No.: 700,916

[30] Foreign Application Priority Data

July 15, 1975 France ..... 75.22036

[52] U.S. Cl. ..... 333/24.2; 333/84 M

[51] Int. Cl.[2] ..... H01P 1/36

[58] Field of Search ..... 333/24.1, 24.2, 24.3

[56] References Cited

UNITED STATES PATENTS

| | | | |
|---|---|---|---|
| 3,845,413 | 10/1974 | Chiron et al. | 333/24.2 X |
| 3,886,502 | 5/1975 | Radding et al. | 333/24.2 |

*Primary Examiner*—Paul L. Gensler
*Attorney, Agent, or Firm*—Kemon & Estabrook

[57] ABSTRACT

A high level broadband VHF isolator using surface propagation made of the waves comprises two gyromagnetic slabs on both sides of a planar metal sheet acting as a double mode transformer or wave launcher between the two terminals of the isolator and the gyromagnetic medium and magnetizing means. The width of the mode transformer is smaller than that of the slabs and radiating slots are provided along at least one side parallel to the propagation direction. The magnetizing field value corresponds to the gyromagnetic resonance at the mid-frequency of the operating band in the neighborhood of the slots and lower elsewhere. Magnetic means are provided to compensate for the temperature variation of the ferrite properties.

6 Claims, 9 Drawing Figures

Isolation (dB)
20
15

3b
1
5
31
32
33
swr
1.4
1.3
1.2
1.1
1.0
3c
Insertion loss
(dB)
4
3
2
1
0
3a
f (MHz)
225
250
275
300
325
350
375
400

Isolation (dB)
25
20
15
10

4b
Pr = 10 w
swr
1,4
1,3
1,2
1,1
1,0
4c
Pi = 40 w
Insertion loss (dB)
3
2
1
0
4a
Pi = 40 w
f (MHz)
225
250
275
300
325
350
375
400

Isolation (dB)

25
20
15
10
+70°C
-40°C
Pr = 10 w
swr
1,4
1,3
1,2
1,1
1,0
-40°C
+70°C
Insertion loss (dB)
Pi = 40 w
2
1
0
-40°C
+70°C
f (MHz)
225
250
275
300
325
350
375
400

α reverse en dB
optimum
8b
Pr = 10w
30
25
20
15
A
B
C
D
E
F
α Direct en dB
8a
1,5
1
0,5
0
optimum
Pi = 40w
Voltmeter V
8d
8
6
4
2
0
8c
1,40
1,30
1,20
1,10
1
Frequency in MHz
125
250
275
300
325
350
375
400

VHF HIGH-POWER BROADBAND ISOLATORS

BACKGROUND OF THE INVENTION AND PRIOR ART

The present invention concerns an improved broadband (about 1 octave) isolator structure operating in the VHF frequency range (200 to 500 MHz) at a high energy level (several tens of watts) and in a wide temperature range (−40° to +70° C) without substantial reduction of the figure of merit.

There has been described in U.S. Pat. No. 3,845,412 applied for by the Applicant on the Oct. 23, 1973 and entitled: "Wideband non reciprocal integrated circuits utilizing surface wave propagation", a broadband isolator structur utilizing surface waves of the quasi-TM mode or of the hybrid $HE_{11}$ mode. FIGS. 3 and 4 of this patent illustrate forms of construction of an isolator whose wave adapter or launcher member, 53' and 66 respectively, has radiating slots 67 which favour the absorption, by a matched load 68, of the energy contained in the backward wave. The illustrated constructions operate in the 3 – 7 GHz range.

Designing isolators operating in the VHF band is a problem. It is well known from experience that gyromagnetic materials can only be used at frequencies of a value of more than $\frac{2}{3}\gamma M$, where $\gamma$ is the gyromagnetic ratio and M is the saturation magnetization. Due to the saturation magnetization values of available materials, the range of this type of device cannot cover VHF.

Recent theoretical studies of the modes of propagation of electromagnetic waves in a thin slab of gyromagnetic material, as published for instance in the Proceedings on the Intermag Conference London 1974 by Messrs. COURTOIS, CHIRON and FORTERRE, under the title : "A survey of broadband stripline ferrite isolators" have shown the existence of two TE modes designated as the magnetostatic mode and the dynamic mode respectively.

The present invention concerns isolators utilizing the dynamic mode. Referring to the notations of FIG. 1, which illustrates a thin slab for gyromagnetic material associated with a trirectangular reference system O, x, y, z, subjected to the action of an external field $H_0$ along Oz, in which the energy travels along Oy, the dimension of the slab in this direction being assumed to be infinite, the dynamic mode is characterized by the following conditions :

| Electric field | Magnetic field |
|---|---|
| $E_x = O$ | $H_x = A \cdot \dfrac{k_y - j\frac{K}{\mu} k_x}{\omega\mu_{eff}}$ |
| $E_y = O$ | $H_y = A \cdot \dfrac{k_x + j\frac{K}{\mu} k_y}{\omega\mu_{eff}}$ |
| $E_z = A$ | $H_z = O$ |

where $A$ is a constant $k_x$ and $k_y$ are the wave numbers $K$ and $\mu$ are the components of the permeability tensor $\mu_{eff}$ is the effective permeability of the material.

BRIEF DISCLOSURE OF THE INVENTION

Stripline isolators according to the present invention are essentially characterized by the following components :

two parallelepipedic thin slabs of gyromagnetic material, whose large dimension is parallel to the direction of propagation :

a conductive sheet disposed between the two thin slabs and connected to two coaxial lugs, of which the dimension perpendicular to the direction of propagation is smaller than that of the thin gyromagnetic slabs, and of which one of the sides, parallel to the direction of propagation, is formed with teeth, the depth of which is such that the distance between the base of the teeth and the edge of the gyromagnetic slabs is equal to one-quarter of the mean wavelength in the operating frequency band ;

a device establishing in the two slabs an external d.c. magnetic field perpendicular to the conductive sheet, of which the non-uniform value is equal to that producing the resonsance of the gyromagnetic material in the neighbourhood of the teeth of the conductive sheet and remains below this value in those parts of the slabs which are situated opposite the solid conductive sheet ;

devices for compensating the external field as a function of the temperature ;

a magnetic yoke structure which closes the induction lines of the external field.

DETAILED DESCRIPTION OF THE INVENTION

Figure 1:
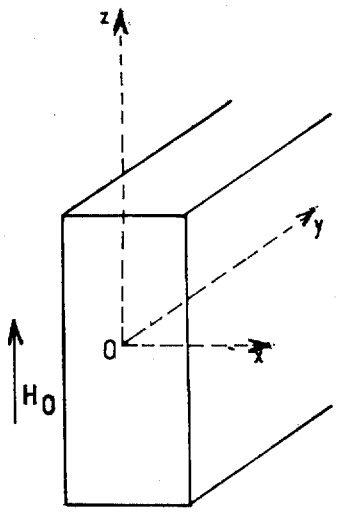
Figure 2:
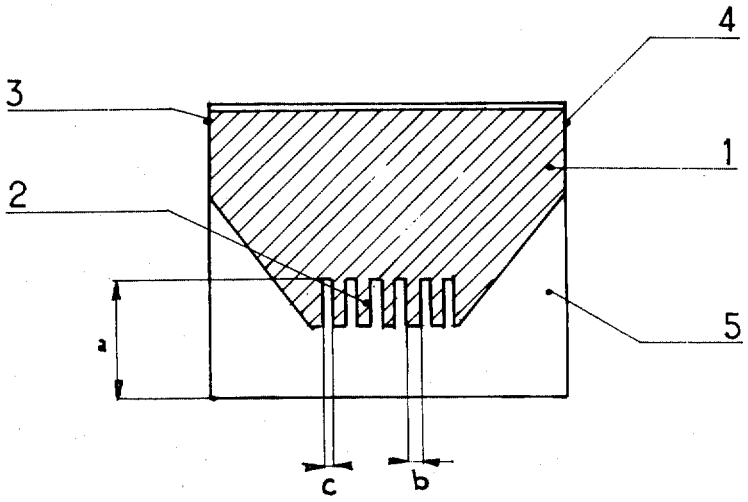
Figure 3:
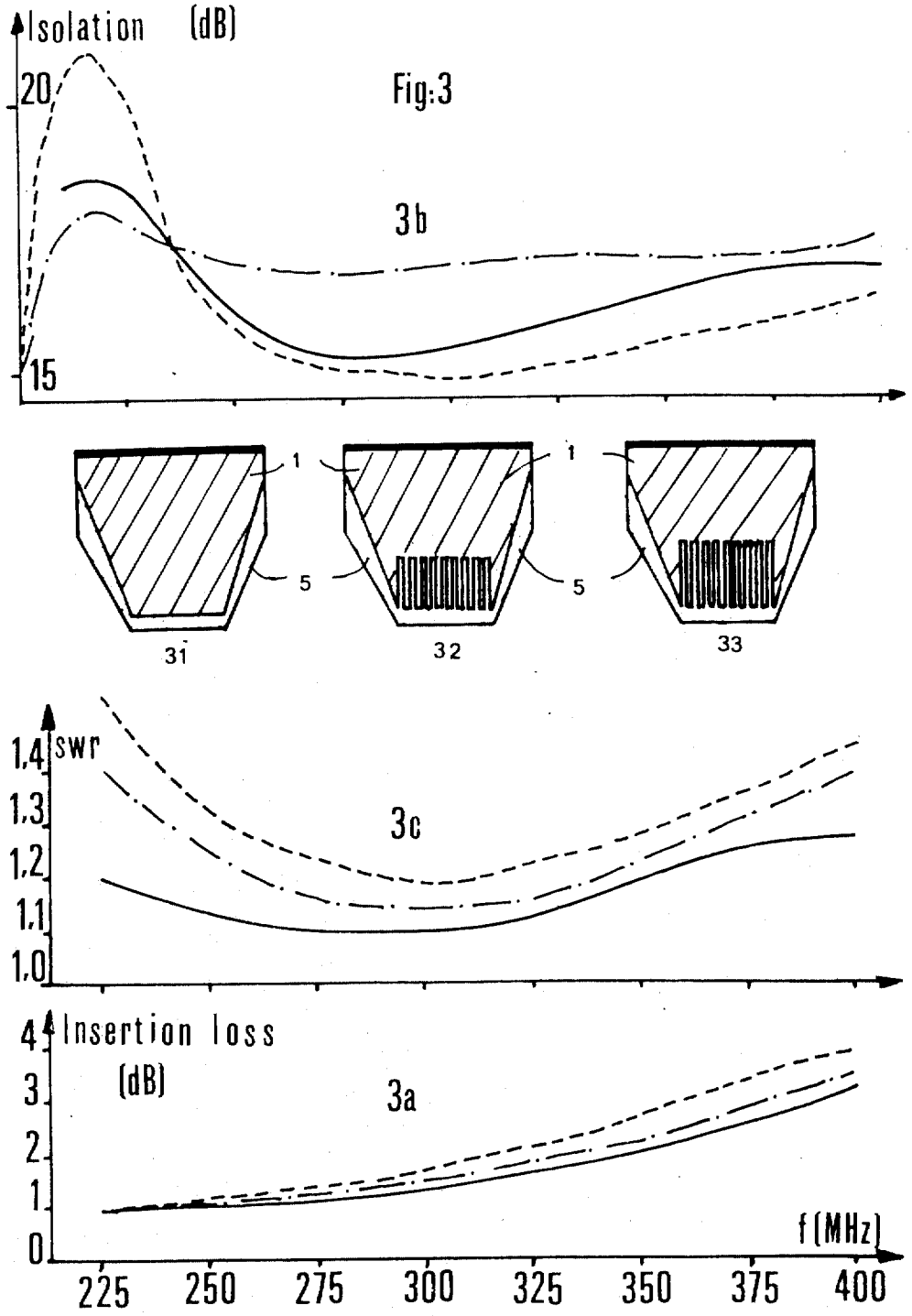
Figure 4:
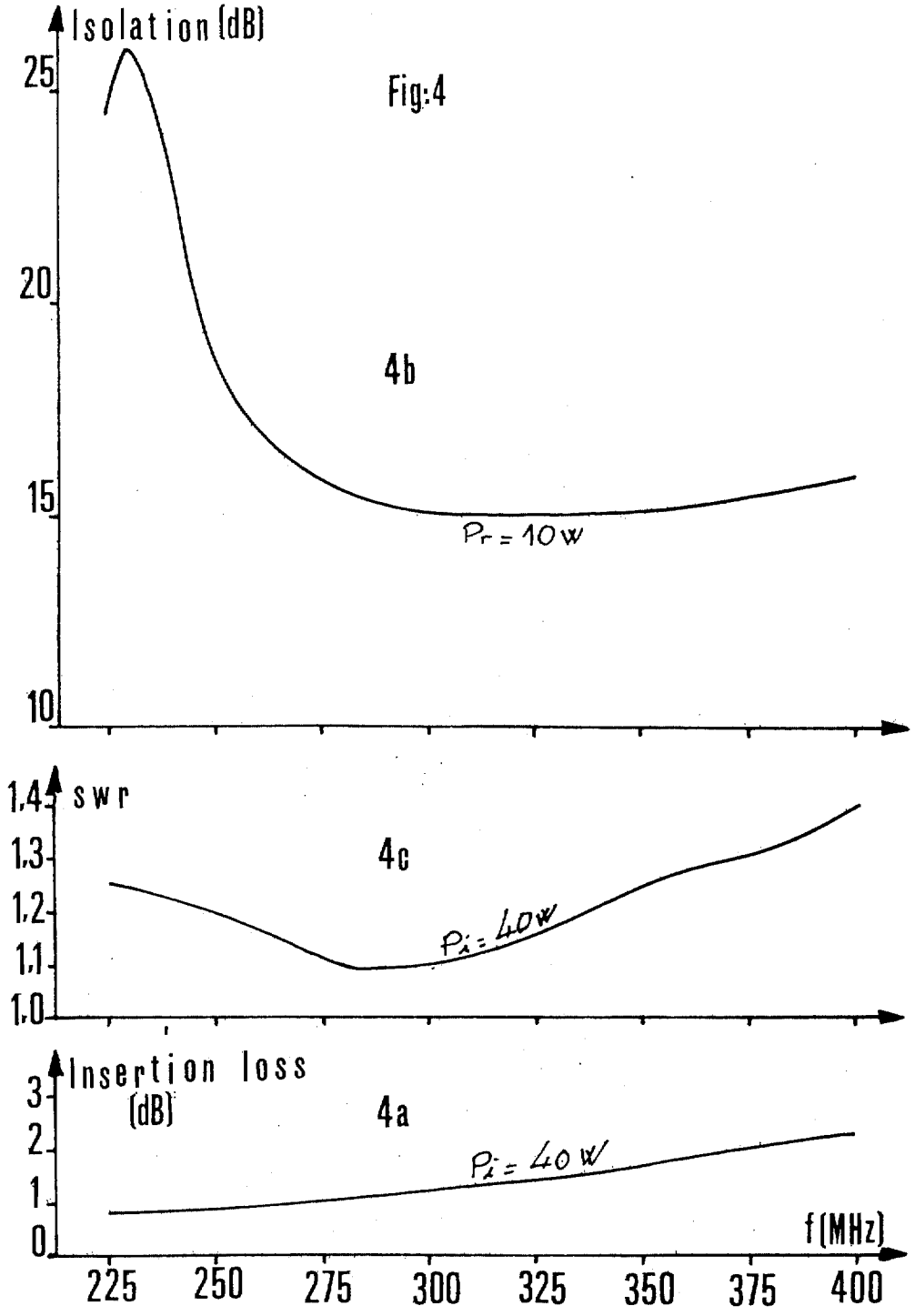
Figure 5:
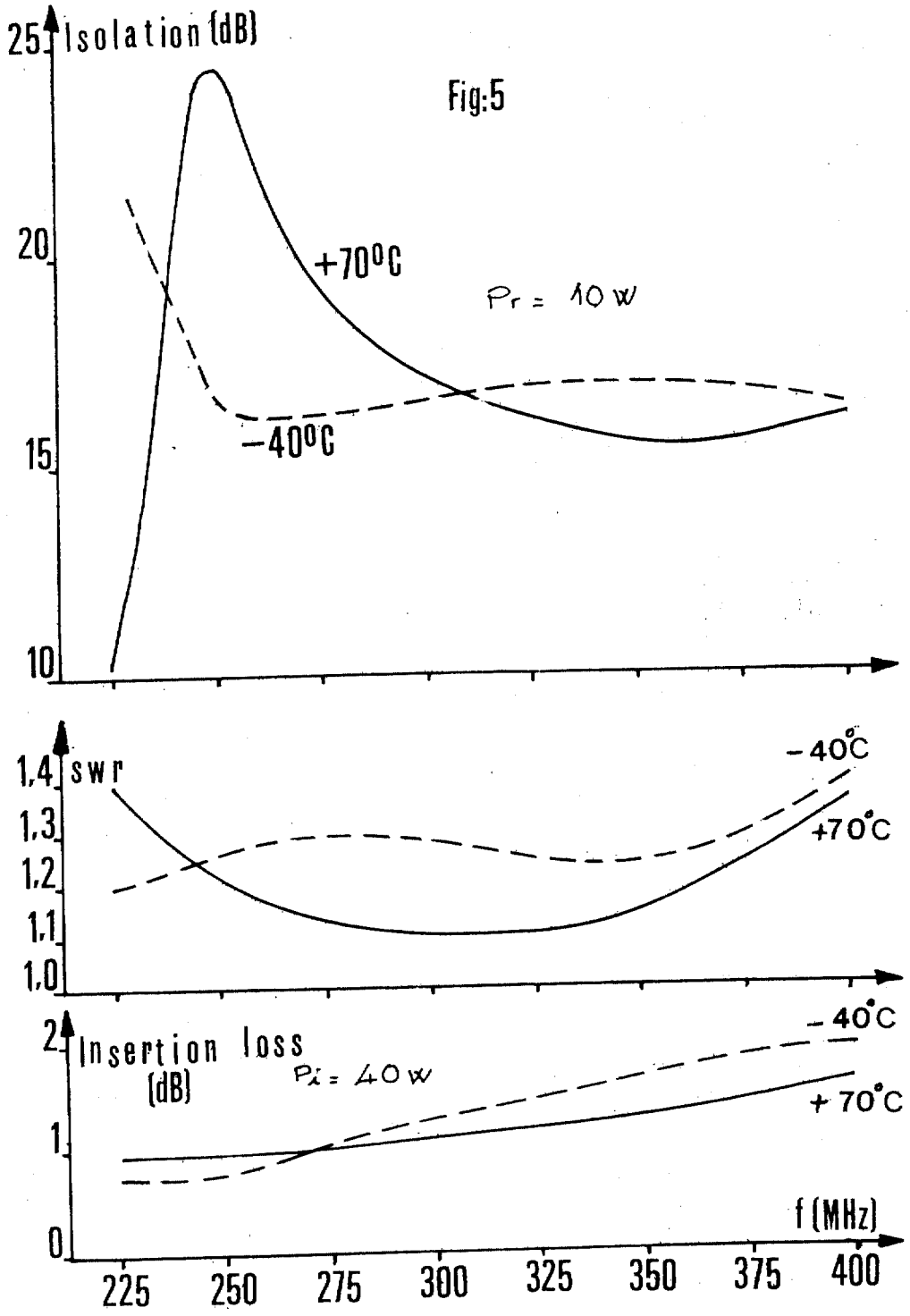
Figure 6:
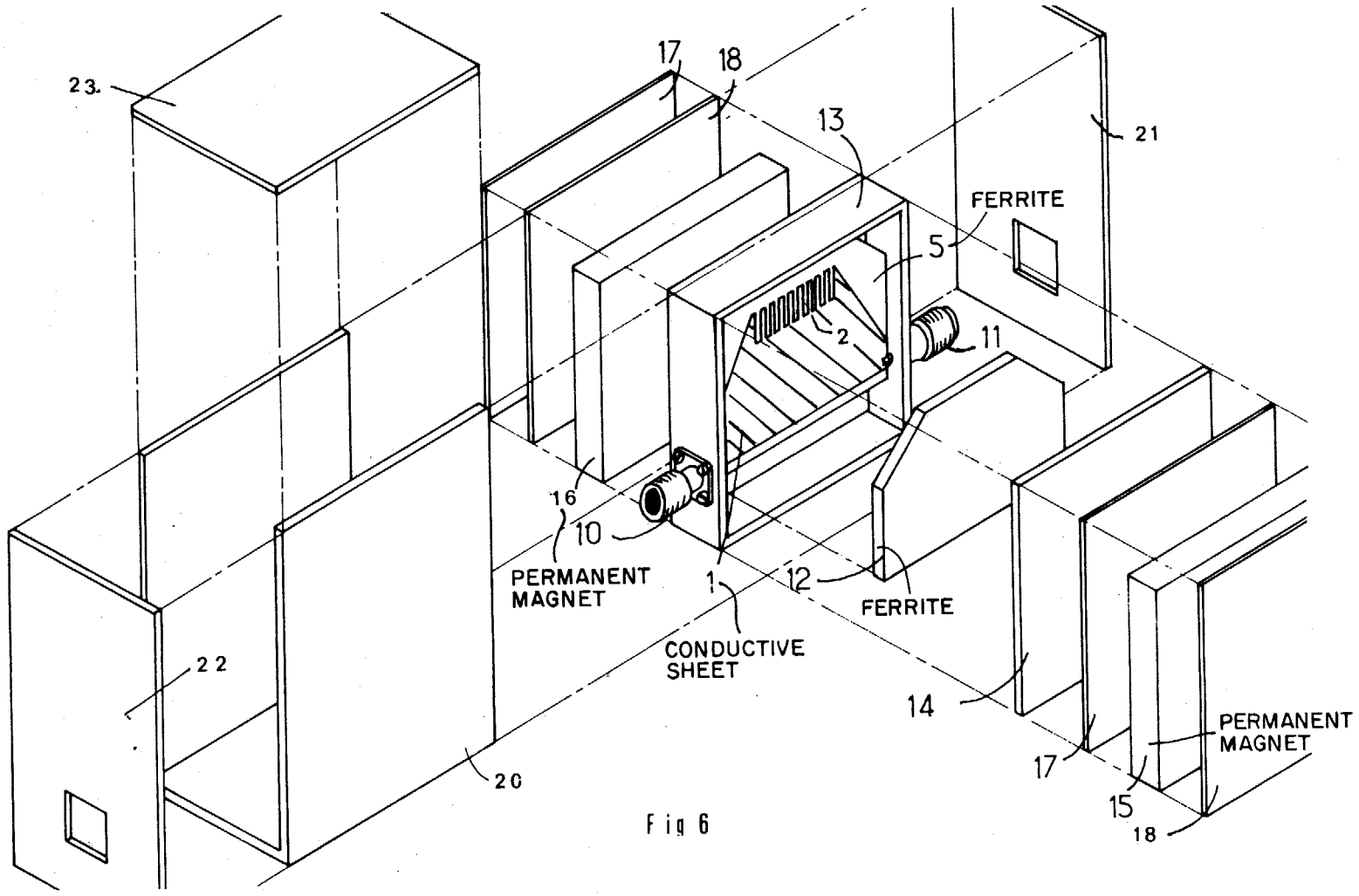
Figure 7:
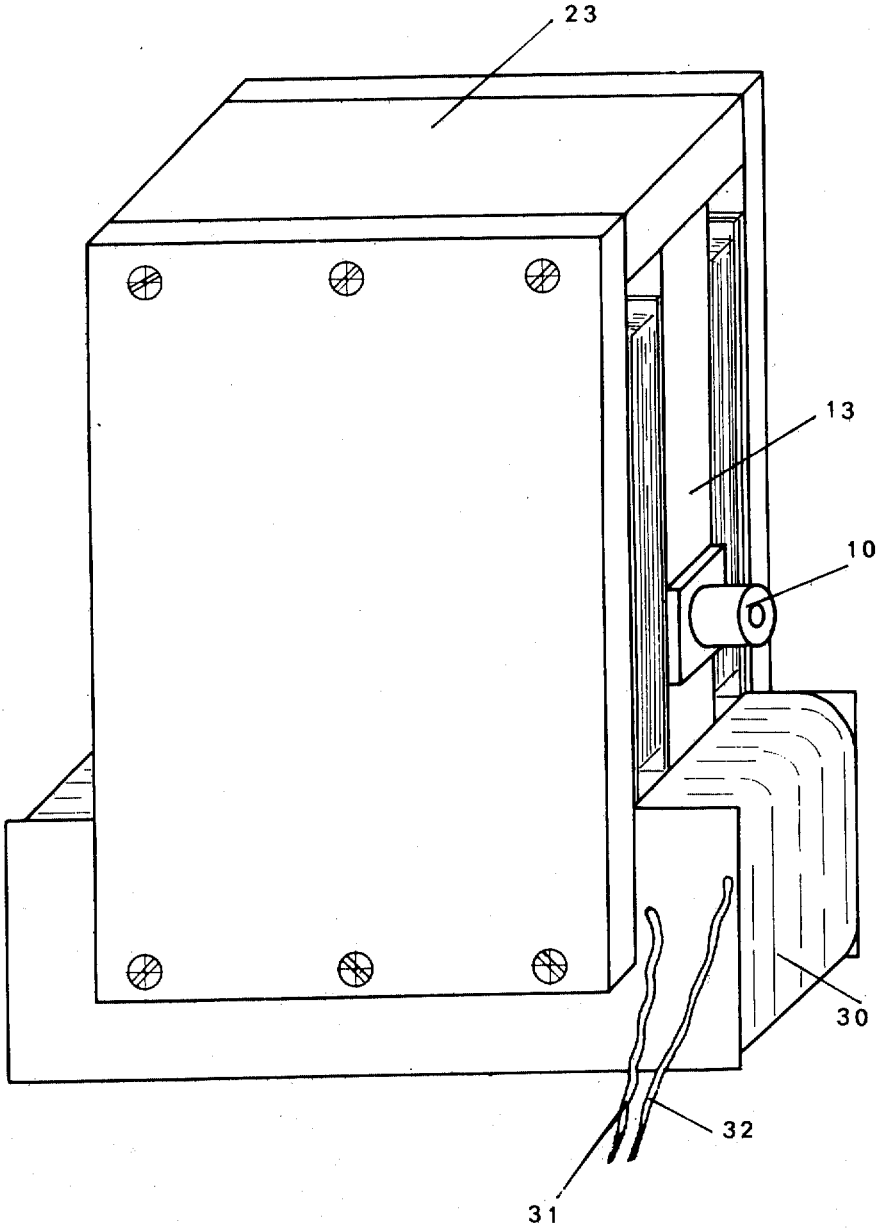
Figure 8:
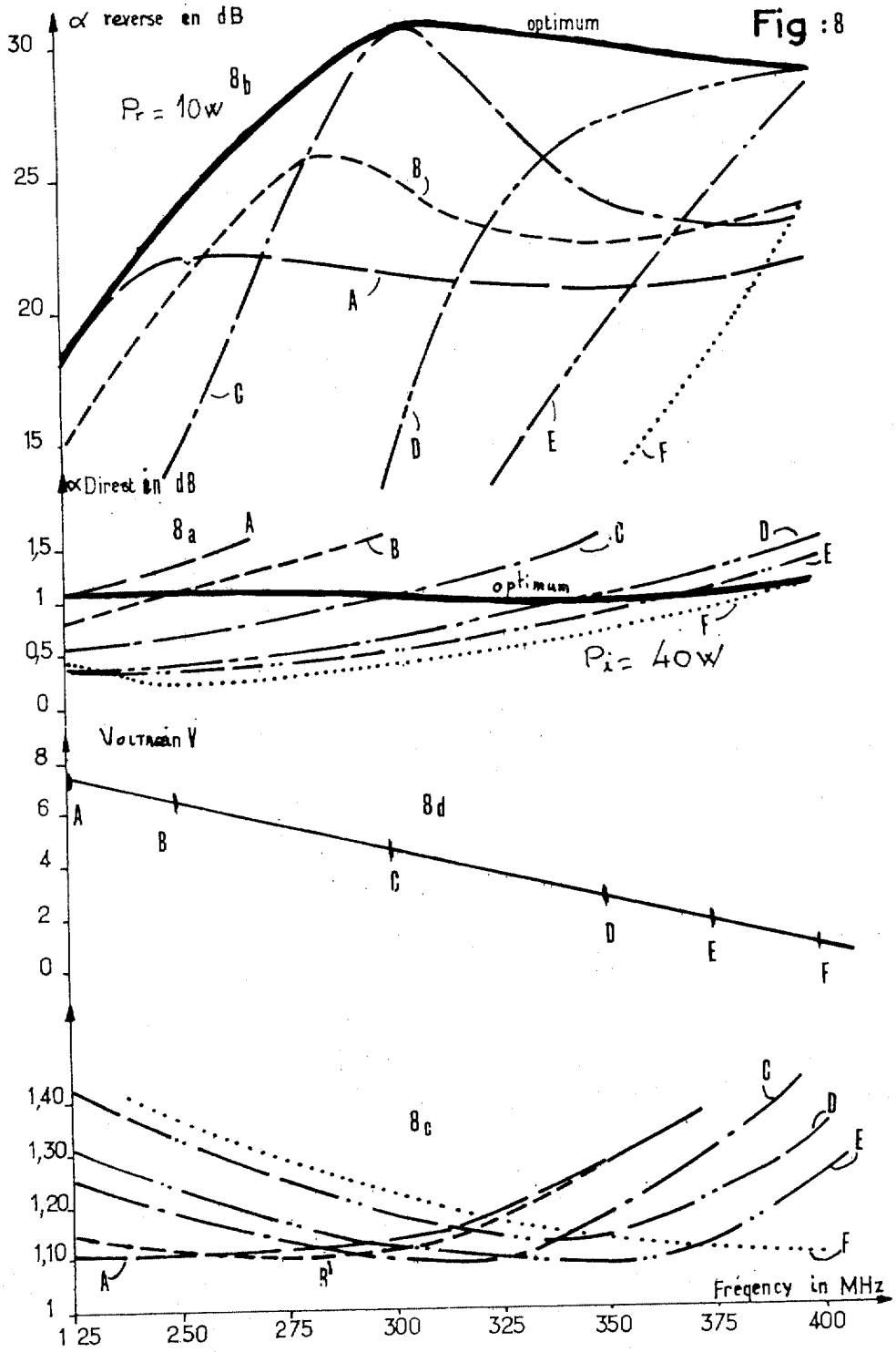

The invention will be readily understood from the following description of a particulr embodiment of the invention and from the accompanying figures, which are given by way of non-limiting illustration and in which :

FIG. 1 defines a reference system,

FIG. 2 is an overhead view of the conductive sheet,

FIG. 3 illustrates the electrical characteristics of fixed frequency devices according to the invention as a function of the frequency, at low level, FIG. 4 illustrates the same characteristics at high level at the ambient temperature for the optimum structure, FIG. 5 illustrates the same characteristics at the extreme temperatures of the operating range, FIG. 6 is an exploded view of the various elements constituting the isolator, and FIGS. 7 and 8 relate to a form of tunable isolator according to the invention.

FIG. 1 has been dealt with in the foregoing.

FIG. 2 illustrates diagrammatically the conductive sheet 1 of an isolator according to the invention. As will be seen, it is of general trapezoidal form and comprises teeth 2 at its smaller base. The small sides 3 and 4 perpendicular to the base are intended for the connection by means of the coaxial plugs terminating the device. 5 is one of the thin slabs of ferromagnetic material. An identical thin slab covers the conductive sheet 1. a is the distance between the base of the teeth at the end adjacent to the thin slab 5, *b* is the width of a tooth and *c* the distance between two successive teeth. The values of these parameters influence the electrical characteristics of the device produced.

The curves of FIG. 3 illustrate at 3*a* the insertion losses, at 3*b* the isolation and at 3*c* the standing wave ratio of three structures which differ only in respect of the geometry of the teeth 2. The chain-lined curves correspond to the characteristics obtained with the aid of a continuous conductive sheet 31 without teeth. The dash-dotted curves correspond to the characteristics of a device 32 having eight teeth, the parameters of which have the following values : $a = 17$ mm, $b = 2.0$ mm and $c = 2.5$ mm. The solid-lined curves correspond to the characteristics of a structure 33 having the same number of teeth, of like dimensions, but of a depth $a = 21.5$ mm. When the curves of FIG. 3*a* are examined, it is found that they remain very similar to one another and the insertion loss between 225 and 400 MHz remains lower than 2.5 dB. Examination of the curves of FIG. 3*b* shows the advantage of structures having teeth. The teeth behave as radiating elements which transform the backward surface wave into a volume wave which is absorbed by the ferrite maintained at the gyromagnetic resonance by the external field. The teeth have very little influence on the insertion loss because the forward wave is propagated on the surface, in the zone where the conductive plane is continuous (in the nieghbourhood of the large base). There is a displacement of the field between the forward wave and the backward wave, as is mentioned in the aforesaid article. The isolation of the structure having no teeth reaches values lower than 15 dB in the band, while the structure having short teeth has an isolation which is always higher than 20 dB in the band. At low level, the shallow teeth appear to be more favourable. Examination of the curves of FIG. 3*c* shows the advantage of the structure laving long teeth over the other two structures in respect of the standing wave ratio. It can be seen that the solid-lined curve is always below the other two and that it exhibits a much less pronounced curvature, the value of the standing wave ratio remaining below 1.30 throughout the band. The curves of FIG. 3 correspond to the performances of the isolator at low level. When it is desired to obtain a device capable of operating at high level, the characteristic of the standing wave ratio is superior to the other two. The preferred variants of the invention involve the use of teeth having the depth corresponding to the variant 33. In the designs used to carry on the measurements summarized in FIG. 3, the conductive sheet consists of a 0.3 mm copper sheet and the thin gyromagnetic slabs are made of type 6901 manufactured by the Assignor, of which the measured magnetic loss coefficent has a value of 7.95. The mid-frequency of the operating band is 312.5 MHz, corresponding to a wavelength in air equal to 96 cm. The wavelength in the garnet which has a permittivity of 16 is therefore equal to 8.51 cm and a quarter of this length is equal to 21.3 mm, which clearly corresponds to the distance $a = 21.5$ mm which was found experimentally to be the most favourable. FIG. 4 illustrates the characteristics of the same device at high level, that is to say, receiving a mean power of 40 watts at the frequency under consideration. The isolation curve 4*b* corresponds to a reflected power of 10 watts. These curves were plotted at ambient temperature. The curves of FIG. 5 represent the same curves plotted at 70° C in the case of the solid-lined curve and at −40° C in the case of the chain-lined curve. The measurements were made on the structure having long teeth, which was considered optimum.

FIG. 6 illustrates the various elements constituting a fixed isolator according to the invention. 1 is the conductive sheet connected to the two plugs 10 and 11 and so disposed that the teeth 2 are situated at the top. This conductive sheet rests on a thin gyromagnetic slab 5. A second thin gyromagnetic slab of the same material is applied to the visible face of the sheet, this slab being designated by 12. The assembly thus formed is positioned in a casing 13 consisting of non-magnetic material, the base of which cannot be seen. The casing is closed by a cover 14. 15 and 16 are respectively the permanent magnets establishing within the thin slabs 5 and 12 the external d.c. magnetic field. This field is equal to the gyromagnetic resonance value in the neighbourhood of the teeth 2 and lower than this value in the remainder of the volume of the thin slabs 5 and 12. Since the gyromagnetic resonance phenomenon is very critical, the magnetic field gradient to be established is small. It is obtained by adjusting the air gap between magnets with the aid of shims (not shown). 17 and 18 are respectively magnetic parts for compensating the field variations as a function of temperature. The magnetic structure is closed by a soft-iron strap shown at 20, which is fitted on the casing 13–14. An enclosure consisting of the faces 21, 22 and 23 of non-magnetic material ensures shielding of the device.

Models of adjustable isolators have been made by disposing around the yoke of the magnetic circuit a coil formed on a rectangular former, through which coil the current is passed. The device is adjusted in such manner that it is tuned to 400 MHz, the field created by the coil being an antagonistic field which is opposed to that created by the saturated magnets 15 and 16.

FIG. 7 illustrates such an isolator assembly. Casing 13 carries the coaxial plug 10. The strap 20, the magnets 15, 16 and the compensating devices 17 and 18 are disposing on either side of the casing, while the coil 30 is mounted on a former around the yoke 20. There are shown at 31 and 32 the two wires feeding the coil, by which the connection to an adjustable source (not shown) is made.

FIG. 8 shows at 8d the variation of the voltage applied to the terminals of the coil 30 of the adjustable isolator. Points A to F of the curve **8*d* correspond to the respective frequencies 225, 250, 300, 350, 375 and 400 MHz. The curves bearing like references in FIGS. 8*a*, 8*b* and 8*c* correspond to the results of the measurements made in the frequency band when the voltage applied to the coil is maintained at the value corresponding to that point of the curve 8*d* which bears the same reference. There are shown in the form of thicker continuous lines the curves corresponding to operation under optimum conditions, that is to say, when the voltage is slaved to the frequency in accordance with the (substantially linear) law of the curve 8*d***.

What we claim is:

1. A broadband high level VHF isolator having two terminals operating in a wide temperature range comprising two gyromagnetic material slabs on both sides of a substantially trapezoidal metal sheet connected respectively to the two terminals, radiating slots defining teeth cut from said sheet along at least one edge parallel to the propagation direction, the distance between the bottom of said teeth and the nearest edge of gyromagnetic slabs material equal to a quarter wavelength within the gyromagnetic material at a frequency in the operating frequency band, means to encase said slab, means to establish a non uniform d.c. magnetic field within said slabs reaching the gyromagnetic valve in the vicinity of said teeth and of lower value elsewhere, means to compensate for the variations of permeability of the gyromagnetic material and the d.c.

establishing means with temperature, and means to close the d.c. magnetic field.

2. A broadband high level VHF adjustable isolator operating in a wide temperature range according to claim 1 comprising a control coil wound on said means to close the d.c. magnetic field.

3. A broadband high level VHF isolator having two terminals operating in a wide temperature range comprising two gyromagnetic material slabs on both sides of a substantially trapezoidal metal sheet connected respectively to the two terminals, radiating slots, defining teeth cut from said sheet along at least one edge parallel to the propagation direction, the width of said sheet in its plane, perpendicularly to the progation direction, being smaller than the corresponding dimension of said slabs, means to encase said slabs, means to establish a non uniform d.c. magnetic field within said slabs reaching the gyromagnetic value in the vicinity of said teeth and of lower value elsewhere, means to compensate for the variations of permeability of the gyromagnetic material and the d.c. establishing means with temperature, and means to close the d.c. magnetic field.

4. A broadband high level VHF adjustable isolator operating in a wide temperature range according to claim 3 comprising a control coil wound on said means to close the d.c. magnetic field.

5. A broadband high level VHF isolator having two terminals operating in a wide temperature range comprising two gyromagnetic material slabs on both sides of a substantially trapezoidal metal sheet connected respectively to the two terminals, radiating slots defining teeth from said sheet along at least one edge parallel to the propagation direction, the width of said teeth being the smallest value which provides impedance match between the metal sheet and the gyromagnetic material, means to encase said slabs, means to establish a non uniform d.c. magnetic field within said slabs reaching the gyromagnetic value in the vicinity of said teeth and of lower value elsewhere, means to compensate for the variations of permeability of the gyromagnetic material and the d.c. establishing means with temperature, and means to close the d.c. magnetic field.

6. A broadband high level VHF adjustable isolator operating in a wide temperature range according to claim 5 comprising a control coil wound on said means to close the d.c. magnetic field.

* * * * *